US009822576B2

(12) United States Patent
Wacker et al.

(10) Patent No.: US 9,822,576 B2
(45) Date of Patent: Nov. 21, 2017

(54) METHOD FOR OPERATING AN ACTIVATABLE LOCKING DEVICE FOR A DOOR AND/OR A WINDOW, SECURING DEVICE FOR A VEHICLE, VEHICLE

(71) Applicant: Robert Bosch GmbH, Stuttgart (DE)

(72) Inventors: Esther-Sabrina Wacker, Hildesheim (DE); Tor Oyvind Didriksen, Gyöngyöshalász (HU)

(73) Assignee: ROBERT BOSCH GMBH, Stuttgart (DE)

( * ) Notice: Subject to any disclaimer, the term of this patent is extended or adjusted under 35 U.S.C. 154(b) by 70 days.

(21) Appl. No.: 14/978,573

(22) Filed: Dec. 22, 2015

(65) Prior Publication Data

US 2016/0177614 A1 Jun. 23, 2016

(30) Foreign Application Priority Data

Dec. 22, 2014 (DE) ..... 10 2014 226 858 U

(51) Int. Cl.

| | |
|---|---|
| ***E05B 77/26*** | (2014.01) |
| ***E05F 15/70*** | (2015.01) |
| ***E05B 77/54*** | (2014.01) |
| ***E05F 15/73*** | (2015.01) |
| *E05B 35/00* | (2006.01) |

(52) U.S. Cl.

CPC ..... *E05F 15/70* (2015.01); *E05B 77/26* (2013.01); *E05B 77/54* (2013.01); *E05F 15/73* (2015.01); *E05B 2035/009* (2013.01)

(58) Field of Classification Search

CPC ..... E05F 15/70; E05F 15/73; E05B 81/78; E05B 83/00; E05B 77/54; E05B 2035/009; E05B 77/26; B60J 1/00; B60J 5/00

USPC ..... 340/5.82

See application file for complete search history.

(56) References Cited

U.S. PATENT DOCUMENTS 8,044,782 B2 * 10/2011 Saban ..... B60N 2/002 340/438

* cited by examiner

*Primary Examiner* — Ali Neyzari

(74) *Attorney, Agent, or Firm* — Norton Rose Fulbright US LLP; Gerard Messina

(57) ABSTRACT

A method is provided for operating an activatable locking device for a door and/or a window of a vehicle, in particular of a motor vehicle, the method including the following steps: detecting a person located in the vehicle and the person's position with respect to the door and/or the displaceable window in the vehicle, ascertaining at least one biometric feature of the person indicative of the age, checking, on the basis of the at least one ascertained biometric feature, whether the person falls below a specifiable limit age, and activating the locking device if the person falls below the specifiable limit age and the position of the person is at the door and/or the displaceable window.

16 Claims, 2 Drawing Sheets

METHOD FOR OPERATING AN ACTIVATABLE LOCKING DEVICE FOR A DOOR AND/OR A WINDOW, SECURING DEVICE FOR A VEHICLE, VEHICLE

FIELD OF THE INVENTION

The present invention relates to a method for operating an activatable locking device for a door and/or a window of a vehicle, in particular of a motor vehicle.

The present invention furthermore relates to a securing device for a vehicle, in particular a motor vehicle, having at least one door and/or at least one displaceable window, having at least one activatable locking device associated with the at least one window and/or the at least one door, and having a control unit.

The present invention furthermore relates to a vehicle, preferably a motor vehicle, having a securing device.

BACKGROUND INFORMATION

It is known from the related art that locking devices for doors and/or window lifters in the vehicle may be manually activated. This may occur either mechanically directly on a door or alternatively electronically via a pressing of a button in the operating console of the driver.

Furthermore, passenger compartment camera systems for vehicles are known from the related art, which may be used to detect persons and faces (Jones, Robust Real-time Object Detection, International Journal of Computer Vision, 2001, 57 (2), pages 137 through 154). Moreover, there exist a multitude of algorithms, by which it is possible to ascertain biometric facial features, which provide insight into the age of the person (Horng, Tamkang Journal of Science and Engineering, 2001, 4 (3), pages 183 through 192; Lobo, Age Classification from Facial Images, Computer Vision and Image Understanding, pages 1 through 21).

SUMMARY

The method of the present invention has the advantage that a locking device for at least one door and/or at least one displaceable window is activated automatically if, on the basis of at least one ascertained biometric age-indicating feature of the person, an inference is made that this person falls below a specific limit age. Accordingly, it is possible to minimize or even exclude the possibility that a child sits near a door and/or a window without the door and/or the window being locked. If no person below a specifiable age is located at the door and/or window, then the locking device for the door and/or the window is not activated and the door and the window may be opened or displaced.

In the present context, the expression "position of the person at the door and/or the window" is understood in such a way that the person is near or next to the door and/or the window, in particular the person is at such a small distance from the door and/or the window that the person does not have to change his or her position, in particular his or her seating position, in order to open the door and/or the window. In particular, the person's position is the most proximate position with respect to the door and/or the window in comparison to a position of another person.

One preferred development of the present invention provides for the at least one biometric age-indicating feature of the person to be selected from the head circumference, the number of facial wrinkles, the ratio of (i) the distance between the two eyes and (ii) the distance between the eye and the nose and the ratio of (iii) the distance between the eye and the nose and (iv) the distance between the eye and the mouth. Advantageously, selecting one or multiple of these biometric features improves the check whether the person falls below a specifiable limit age. In particular, this has the result that an increased number of persons are correctly identified as persons that falls below a certain specifiable limit age. The term "distance between the two eyes" is understood as the distance between the pupil of the left eye and the pupil of the right eye of a person situated in the vehicle. The term "distance between the eye and the nose" is understood as the distance between the right or the left pupil of a person situated in the vehicle and the tip of the nose of a person situated in the vehicle. The term "distance between the eye and the mouth" is understood as the distance between the left or the right pupil of a person situated in the vehicle and the lowest point of the Cupid's bow of the upper lip of a person situated in the vehicle.

To detect the at least one biometric feature, it is possible to perform a method known from the related art, in particular a 3D face detection.

A preferred development of the present invention provides for the at least one biometric feature to be the seated height of the person. The selection of this biometric feature yields a reliable statement regarding the possible age of the detected person in a simple and easily determinable manner. The term "seated height" is understood in the present context as the distance between the seat surface, in particular the seat surface without the person sitting on it, and the highest point of the person in the vehicle.

A preferred development of the present invention provides for at least one further biometric feature to be ascertained in addition to the seated height. This increases the accuracy of the detection whether a person falls below a specifiable limit age. Preferably, only face-specific biometric features of the at least one person are ascertained.

In one preferred development of the present invention, for performing the check in accordance with step c), the at least one biometric feature is compared to at least one reference value stored in a non-volatile memory. This comparison improves the accuracy of the detection and determination whether a person falls below a certain specifiable limit age. In particular, in this non-volatile memory, it is possible to store reference values of one or multiple biometric age-indicating features. The check whether a person falls below a specifiable limit age preferably occurs in that first the at least one biometric age-indicating feature is ascertained, is then compared to at least one reference value stored in the non-volatile memory, and, if there is an agreement between the at least one ascertained biometric feature and the reference value and the position of the person is at the door and/or the window, the at least one locking device is activated. Preferably, at least one biometric feature is ascertained of all persons in the vehicle.

One preferred development of the present invention provides for the locking device, in the activated state, to prevent the door from being opened from inside or the window from being opened. Accordingly, the automated process of the detection prevents the door and/or the window from being opened, even though a person falling below a specifiable limit age is sitting there.

The specifiable limit age is preferably selected in such a way that the locking device is activated in the case of babies, toddlers and children. The specifiable limit age is preferably set to ten years. The method according to the present invention makes it possible to ascertain, on the basis of biometric age-indicating features, whether a person falls below a certain specifiable limit age. This method is intended to activate a locking device for a door and/or a window if a respective person, in particular a baby, a toddler or a child, sits near the door and/or the window. This method performs a check on the basis of biometric features. Accordingly, the possibility cannot be excluded that persons who do not fall below the specifiable limit age, but who have the same biometric features as persons who actually fall below the specifiable limit age, are likewise classified as persons who fall below this specifiable limit age.

The securing device according to the present invention is characterized in particular by a detection device for detecting a person located in a vehicle and the person's position regarding the at least one door and/or the at least one displaceable window and for ascertaining at least one biometric age-indicating feature of the person as well as by a control unit that carries out the method of the present invention when used as intended. However, this yields the advantages already mentioned previously. The securing device according to the present invention is in particular integrated in a vehicle, in particular a motor vehicle.

The detection device is in particular a sensor, a camera, in particular a video camera. The detection device in particular must be disposed in the vehicle in such a way that its field of view is directed at the faces of the persons to be detected. In particular, the at least one camera must be attached in the vehicle in such a way that it is able to detect completely both the front seats as well as the rear seats. Preferably, at least one camera, preferably having a wide-angle lens, is disposed in the front region, preferably in the cockpit region, as well as at least one camera in the rear region of the vehicle.

The vehicle, preferably a motor vehicle, according to the present invention is in particular characterized by the securing device of the present invention. However, this yields the advantages already mentioned previously.

In the following, the present invention will be explained in greater detail with reference to drawings.

DETAILED DESCRIPTION

Figure 1:
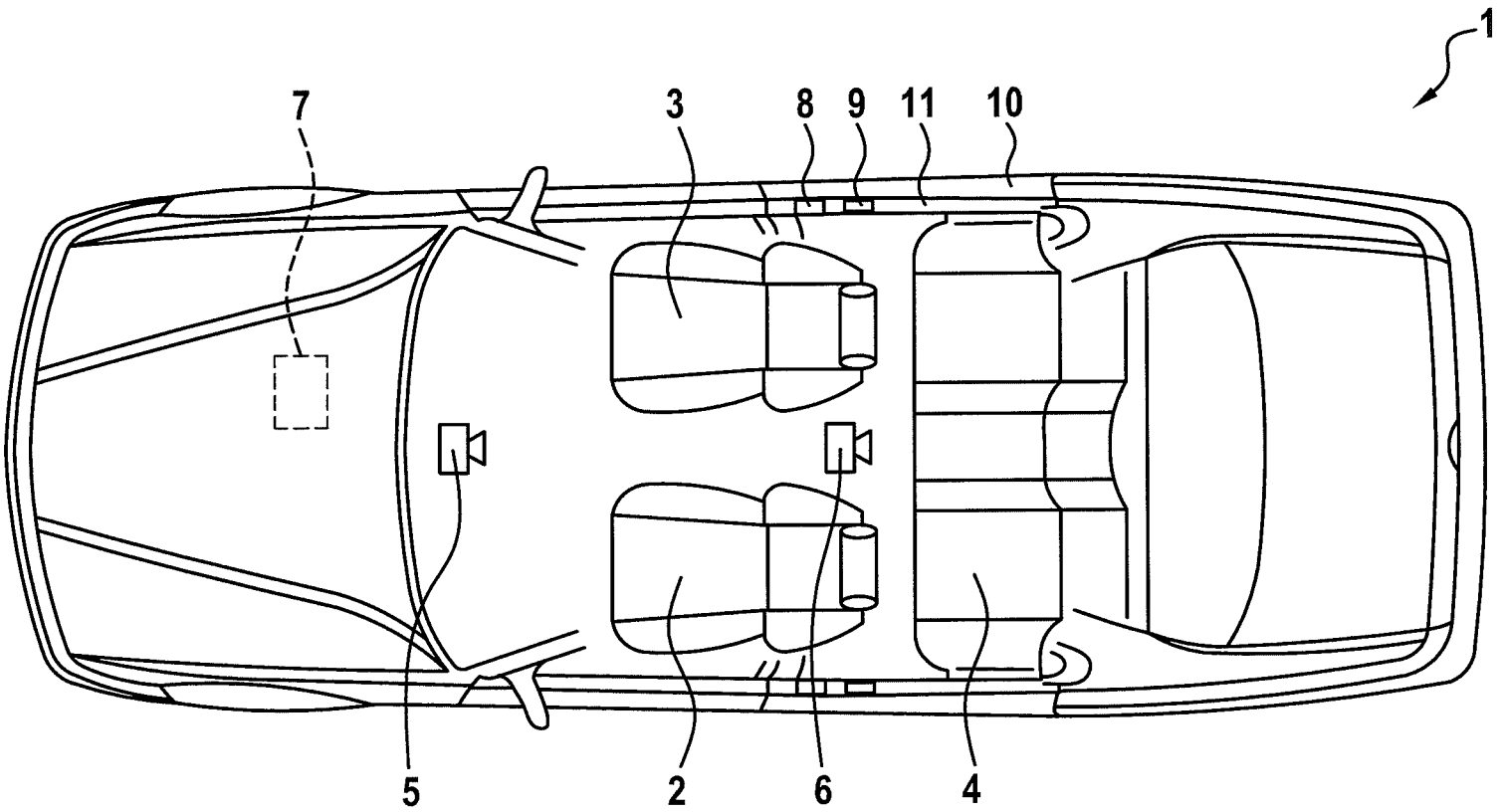
FIG. 1 shows a schematic representation of a vehicle in a top view.

FIG. 1 shows a vehicle 1 having a driver seat 2 and a front passenger seat 3 as well as a rear-seat bench 4. Two cameras 5 and 6 are likewise situated in the vehicle, which are able to detect one or more or all persons situated in the vehicle and their position with respect to one or more or all doors and/or one or more or all windows. Camera 5 is used to detect persons sitting in the driver seat 2 and the front passenger seat 3, and camera 6 is used to detect persons sitting on the rear-seat bench. In addition, using cameras 5, 6 situated in vehicle 1, it is possible to ascertain one or multiple biometric features that indicate the age of a person. Accordingly, software for ascertaining at least one biometric age-indicating feature of the person is integrated in cameras 5 and 6 or is operatively connected to these. The software for ascertaining the biometric feature of the person may also be integrated in a control unit 7 situated in or on the vehicle. Control unit 7 is used in particular to check whether one or multiple persons in vehicle 1 fall below a specifiable limit age. If control unit 7 detects that a person situated at rear right door 10 and window 11 of vehicle 1 falls below a certain specifiable limit age, then a locking device 8 situated in vehicle 1 for the door 10 and a locking device 9 for window 11 are activated. Corresponding locking devices 8, 9 preferably also exist on or in the other doors and/or windows (not shown here).

Figure 2:
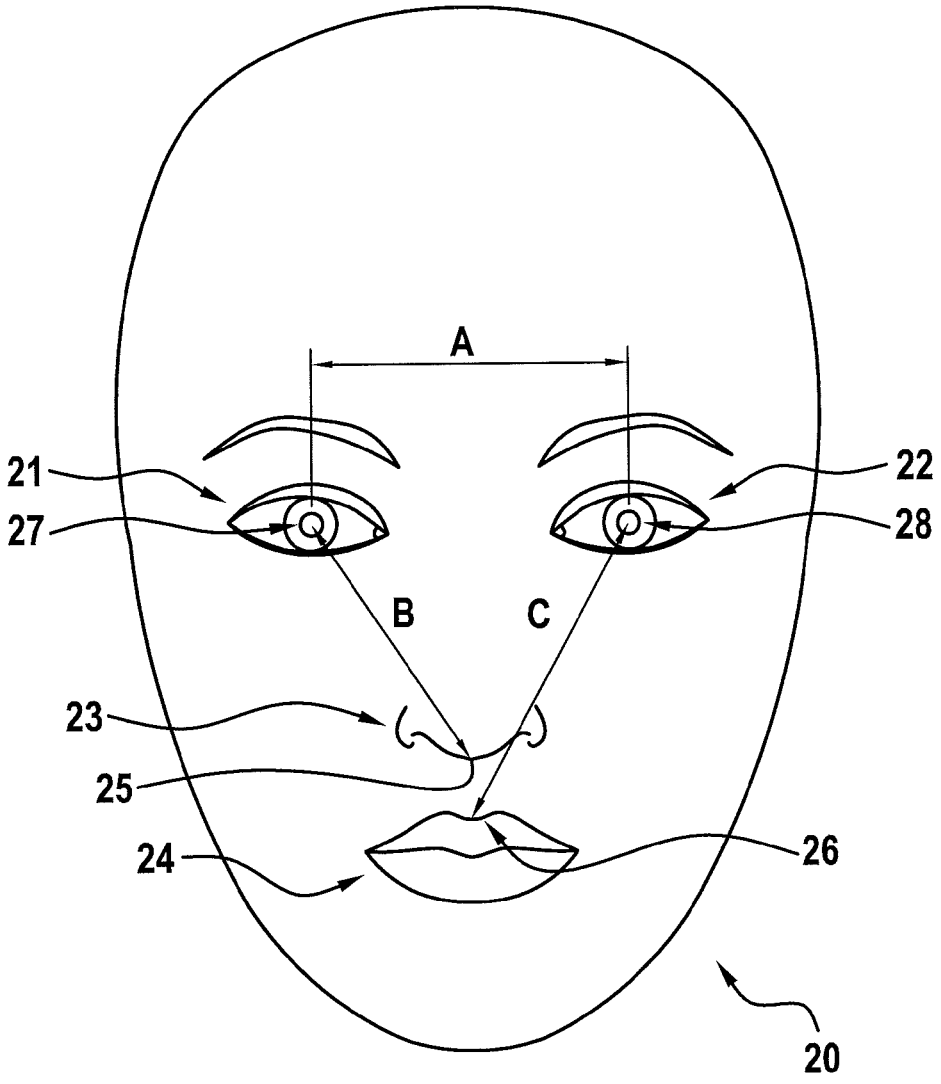
FIG. 2 shows a schematic representation of a face.

FIG. 2 shows a schematic representation of a face 20 including a left eye 21, a right eye 22, a nose 23 and a mouth 24. Nose 23 has a nose tip 25 and the upper lip of mouth 24 has a Cupid's bow 26. Eyes 21 and 22 respectively have a pupil 27 and 28. FIG. 2 shows the distances between pupils 27 and 28 (corresponding to distance A), the distance between right pupil 27 and the tip of the nose 25 (corresponding to distance B) and the distance between left pupil 28 and the lowest point of Cupid's bow 26 of the upper lip. These distances A, B and C are preferably ascertained by a detection device shown in FIG. 1 in order to be able to check in another method step whether a person falls below a specifiable limit age. Alternatively or additionally, the detection device ascertains the circumference of the head, the number of facial wrinkles and/or the seated height of a person situated in the vehicle. Preferably, at least two different biometric features are ascertained in order to check whether a person falls below a specifiable limit age. To detect the at least one biometric feature, it is possible to use a method known from the related art, in particular a 3D face detection.

What is claimed is:

1. A method for operating an activatable locking device for at least one of a door and a displaceable window of a vehicle, comprising:

detecting a person located in the vehicle and a position of the person with respect to the at least one of the door and the displaceable window in the vehicle;

ascertaining at least one biometric feature of the person that indicates an age;

checking, on the basis of the at least one ascertained biometric feature, whether the person falls below a specifiable limit age; and activating the locking device if the person falls below the specifiable limit age and the position of the person is at the at least one of the door and the displaceable window.

2. The method as recited in claim 1, wherein the vehicle is a motor vehicle.

3. The method as recited in claim 1, wherein the at least one biometric feature is selected from one of a head circumference, a number of facial wrinkles, a ratio of a distance between eyes of the person and a distance between one of the eyes and a nose, and a ratio of the distance between the one of the eyes and the nose and a distance between the one of the eyes and a mouth.

4. The method as recited in claim 1, wherein a seating height of the person is selected as the at least one biometric feature.

5. The method as recited in claim 4, wherein, besides the seating height of the person, at least one additional biometric feature indicating the age is ascertained.

6. The method as recited in claim 1, the checking includes comparing the at least one ascertained biometric feature to at least one reference value stored in a non-volatile memory.

7. The method as recited in claim 1, wherein the locking device in an activated state one of prevents the door from being opened from inside and prevents the displaceable window from being opened.

8. A securing device for a vehicle having at least one of at least one door and at least one displaceable window, comprising:

at least one activatable locking device associated with the at least one of the at least one window and the at least one door;

a control unit; and a detection device for:

detecting a person located in a vehicle and a position of the person with respect to the at least one of the at least one door and the at least one displaceable window, and ascertaining at least one biometric age-indicating feature of the person, the control unit carrying out a method including:

detecting the person located in the vehicle and the position of the person with respect to the at least one of the at least one door and the at least one displaceable window in the vehicle, ascertaining the at least one biometric feature of the person that indicates an age, checking, on the basis of the at least one ascertained biometric feature, whether the person falls below a specifiable limit age, and activating the locking device if the person falls below the specifiable limit age and the position of the person is at the at least one of the at least one door and the at least one displaceable window.

9. The securing device as recited in claim 8, wherein the vehicle is a motor vehicle.

10. A vehicle, comprising:

at least one of at least one door and at least one displaceable window; and a securing device for a vehicle, the securing device including:

at least one activatable locking device associated with the at least one of the at least one window and the at least one door, a control unit, and a detection device for:

detecting a person located in a vehicle and a position of the person with respect to the at least one of the at least one door and the at least one displaceable window, and ascertaining at least one biometric age-indicating feature of the person, the control unit carrying out a method including:

detecting the person located in the vehicle and the position of the person with respect to the at least one of the at least one door and the at least one displaceable window in the vehicle, ascertaining the at least one biometric feature of the person that indicates an age, checking, on the basis of the at least one ascertained biometric feature, whether the person falls below a specifiable limit age, and activating the locking device if the person falls below the specifiable limit age and the position of the person is at the at least one of the at least one door and the at least one displaceable window.

11. The vehicle as recited in claim 10, wherein the vehicle is a motor vehicle.

12. The securing device as recited in claim 8, wherein the at least one biometric feature is selected from one of a head circumference, a number of facial wrinkles, a ratio of a distance between eyes of the person and a distance between one of the eyes and a nose, and a ratio of the distance between the one of the eyes and the nose and a distance between the one of the eyes and a mouth.

13. The securing device as recited in claim 8, wherein a seating height of the person is selected as the at least one biometric feature.

14. The securing device as recited in claim 13, wherein, besides the seating height of the person, at least one additional biometric feature indicating the age is ascertained.

15. The securing device as recited in claim 8, wherein the checking includes comparing the at least one ascertained biometric feature to at least one reference value stored in a non-volatile memory.

16. The securing device as recited in claim 8, wherein the locking device in an activated state one of prevents the door from being opened from inside and prevents the displaceable window from being opened.

* * * * *